United States Patent [19]

Reichert

[11] 4,127,970

[45] Dec. 5, 1978

[54] SUSPENDED FLEXIBLE CONTAINER

[75] Inventor: Wolfgang Reichert, Bietigheim-Bissingen, Fed. Rep. of Germany

[73] Assignee: Walter Krause, Waldheim, Fed. Rep. of Germany

[21] Appl. No.: 738,237

[22] Filed: Nov. 2, 1976

[30] Foreign Application Priority Data

Nov. 11, 1975 [DE] Fed. Rep. of Germany ..... 2550526

[51] Int. Cl.[2] ..... E04H 7/24; E04B 1/12; E04B 1/347

[52] U.S. Cl. ..... 52/63; 29/446; 52/197

[58] Field of Search ..... 29/452, 446; 52/245, 52/63, 192, 194, 197, 224

[56] References Cited

U.S. PATENT DOCUMENTS

| | | | |
|---|---|---|---|
| 3,664,072 | 5/1972 | Lieckfeld | 52/245 X |
| 3,712,002 | 1/1973 | Hillinger et al. | 52/197 X |

FOREIGN PATENT DOCUMENTS

| | | | |
|---|---|---|---|
| 2257170 | 6/1973 | Fed. Rep. of Germany | 52/194 |

*Primary Examiner*—Charlie T. Moon
*Attorney, Agent, or Firm*—Michael J. Striker

[57] ABSTRACT

A method of pretreating suspended flexible containers of the type including an upper tubular part of a flexible material and a lower bottom rigid part. The method comprises applying to a lower edge portion of the upper tubular part a pulling force in a longitudinal direction towards the lower bottom part so that the upper tubular part elongates to its maximum length, and subsequent fixedly connecting the lower edge of the upper tubular part to the lower bottom part. An arrangement for pretreating such containers comprises means for suspending the container by an upper edge portion of the tubular part, pulling means for pulling the lower edge of the upper tubular parts in a longitudinal direction to the lower bottom part and for subsequently fixedly connecting the lower edge of the upper tubular part to the lower bottom part, means for connecting the pulling means to the upper tubular part, and means for connecting the pulling means to the lower bottom parts.

9 Claims, 4 Drawing Figures

SUSPENDED FLEXIBLE CONTAINER

BACKGROUND OF THE INVENTION

The present invention relates to a method of pretreating suspended containers of a flexible material and an arrangement for performing this method.

It is known to use containers of flexible material, as storage silos by suspending them in upright positions. Such containers may accommodate large amounts of material therein, for example, more than 20 tons. It has, however, been found that the flexible container essentially elongates upon receiving the material therein and subsequently goes back after discharging the material therefrom to its original length with only small residual deformation. Such movements of the flexible container in the opposite directions are especially undesirable in the cases where the discharging means of the container is connected to rigid systems, such as metering or dosing devices or conveyers. If the flexible container is connected to the rigid system, in an initial position of the container before an elongation thereof, a subsequent elongation of the container upon receiving the material therein, causes an overhanging of the container, leading to bending of some of its wall portions. This creates difficulties because it interferes with proper discharge of the material from the container. In cases where the container is connected to the rigid systems only after it has received the material to be stored, it is necessary to take into account the stresses resulting from a subsequent shortening of the container after a discharge of material therefrom, which can damage the rigid systems connected to the container.

SUMMARY OF THE INVENTION

Accordingly, it is a general object of the present invention to avoid the disadvantages of the priorart suspended flexible containers.

More particularly, it is an object of the present invention to provide such method and arrangement for pretreating suspended flexible container of the type including an upper tubular part of a flexible material and a lower rigid bottom part, that the flexible upper tubular part does not perform movements in opposite direction during receiving the material in the container and discharging the material therefrom, respectively.

It is a further object of the present invention to provide a suspended flexible container of the above mentioned type which upper flexible tubular part does not elongate during receiving the material therein.

Yet another object of the present invention is to provide a suspended flexible container having constituent parts which absorb forces which are developed during discharging of the material from the container.

In pursuance of these objects and others which will become apparent hereafter, one feature of the present invention resides in a method of pretreating suspended flexible container of the type including an upper tubular part of a flexible material and a lower bottom part. Briefly stated, the method comprises applying to a lower edge portion of the upper tubular part a pulling force in a longitudinal direction towards the lower bottom part, so that the upper tubular part elongates to its maximum length; and subsequently fixedly connecting the lower edge portion of the upper tubular part of the lower bottom part.

This assures that during the receipt of the material in the upper tubular part of the container this part does not further elongate. On the other hand, forces developed during discharging of the material from the container and tending to shorten the upper flexible part of the container are absorbed because the lower edge of the upper tubular part is fixedly connected to the lower bottom part. Thus, no movements of the flexible container in mutually opposite directions can occur.

An arrangement for performing the above mentioned method of pretreating suspended flexible containers comprises means for suspending the container by an upper edge portion of the upper tubular part, means for pulling the lower edge portion of the upper tubular part in a longitudinal direction towards the lower bottom part and subsequently fixedly connecting the lower edge portion of the upper tubular part to the lower bottom part, means for connecting the pulling means to the upper tubular part, and means for connecting the pulling means to the lower bottom part.

The means for connecting the pulling means to the upper tubular part comprises an upper pocket-shaped member connected to the lower edge portion of the upper tubular part and having openings with substantially horizontal axes, a circumferentially closed upper reinforcing member extending through the upper pocket-shaped member, and projections fixedly connected to the upper reinforcing member and extending through the openings. The projections have upper bores with substantially vertical axes.

Similarly, the means for connecting the pulling means to the lower bottom part comprises a lower pocket-shaped member connected to the upper edge portion of the lower bottom part and having openings with substantially horizontal axes, a circumferentially closed lower reinforcing member extending through the lower pocket-shaped member, and projections fixedly connected to the lower reinforcing member and extending through the openings. The projections have lower bores with substantially vertical axes in alignment with the upper bores of the means for connecting the pulling means to the upper tubular part.

The pulling means comprises screw bolts extending through the upper bores and the lower bores, and nuts threaded into these screw bolts. Threading of the nuts causes a movement of the means for connecting said pulling means to the upper tubular part towards the means for connecting the pulling means to the lower bottom part so that the lower edge portion of the upper tubular part is pulled towards the lower bottom part and is thereafter fixedly connected to the latter.

Of course, the upper tubular part is not directly connected to the lower bottom part so as to form therewith an integral part without a gap therebetween. The upper tubular part is so located relative to the lower bottom part that in an initial position of the tubular part before any elongation thereof it is spaced from the lower bottom part at a predetermined distance. In this connection, the arrangement comprises a tubular intermediate member located in a space between the upper tubular part and the lower bottom part and fixedly connected to at least the upper tubular part. The intermediate member has a length larger than the predetermined distance between the parts of the container and is arranged to lie on the inner surface of the lower bottom part during the elongation of the upper tubular part. The intermediate member can be connected to the lower edge of the upper tubular part by means of glueing, welding or sewing. The intermediate member can be made of flexible material to perform its above mentioned function.

When the material is admitted into the container, the intermediate members lies on the inner surface of the lower bottom part and is firmly pressed to this surface under the weight of the material. The intermediate member also can be made of a rigid material. In this case it comprises two separate tubular seal-like sections respectively connected to the upper tubular part and to the lower bottom part. The separate tubular sections of the intermediate member are so arranged that during the elongation of the upper tubular part they engage and slide along one another and thereafter are fixedly connected to one another in an ultimate engaged position. The intermediate member serves to close the space between the upper tubular part and the lower bottom part of the container.

The upper tubular part and the lower bottom part can have circular, square, oval or other cross-sections. The reinforcing members are shaped to follow the cross-sections of the parts of the container. In a construction in which the parts of the container are of a circular cross-section, the reinforcing members are split rings having means for connecting the ends thereof to one another. In a construction wherein the parts are of square cross-sections, the reinforcing members are frames comprising separate side sections and means for connecting the side sections to one another.

The arrangement comprises a support structure for supporting the lower bottom part. The reinforcing member of the means for connecting the pulling means to the lower bottom part is fixedly connected to the support structure.

The means for suspending the container comprises a further pocket-shaped member connected to the upper edge portion of the upper tubular part of the container and having openings, a circumferentially closed reinforcing member extending through the further pocket-shaped member, and a suspending structure extending through said openings and fixedly connected to the reinforcing member.

Finally, the lower bottom part of the container can be funnel-shaped, and discharge means are mounted at a lower portion of the funnel-shaped bottom part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
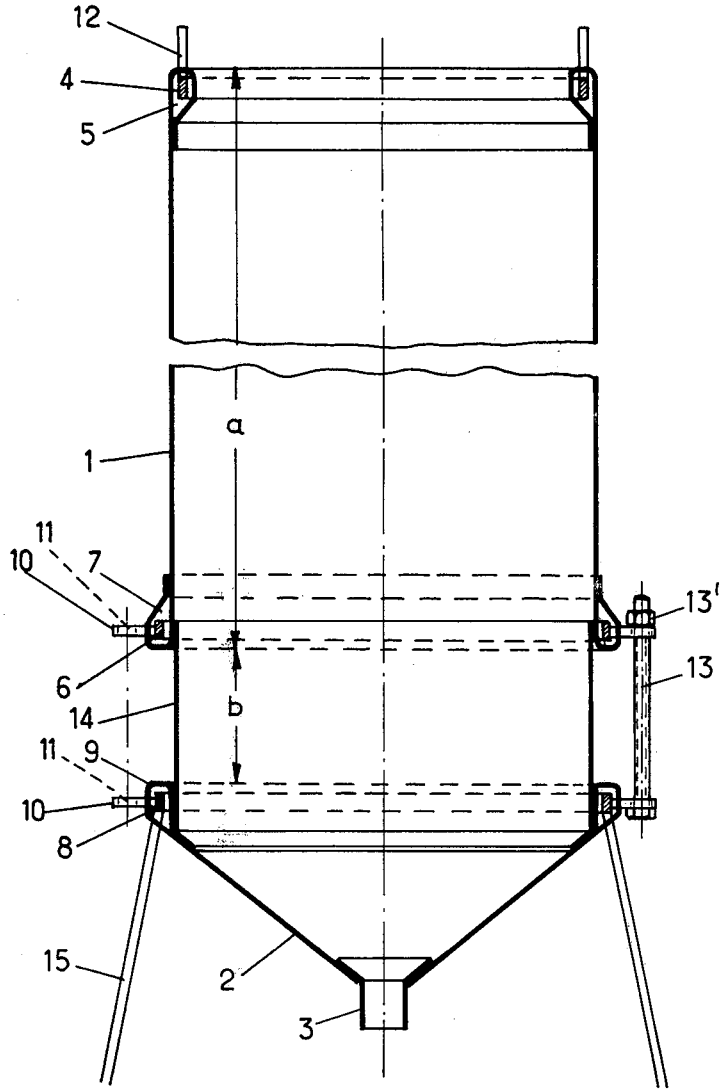
FIG. 1 is a side elevational view of an arrangement for pretreating suspended flexible containers of the present invention.

Referring now to the drawing, and first to FIG. 1 thereof, it may be seen therein that an upper tubular part of a container of the present invention is designated with reference numeral 1. The upper tubular part of the container is made of a flexible material, and its initial length before any elongation thereof is designated with a reference character "*a*". A lower bottom part of the container is designated with a reference numeral 2. The lower part 2 of the container is rigid and is spaced from the upper tubular part 1 at a predetermined distance "*b*". The lower part 2 is funnel-shaped and carries at its lower portion discharge means such as an outlet nozzle 3.

An upper edge portion of the upper tubular part 1 comprises a further pocket-shaped member 5 formed as a continuation of the upper edge portion. A circumferentially closed reinforcing member 4 extends through the further pocket-shaped member 5. A suspending structure 12 extends through openings (not shown in the drawing) in the further pocket-shaped member 5 and is fixedly connected to the reinforcing member 4. In this embodiment the container is open at a top thereof; however, it is understood that it can be provided with a cover attached or planed onto the upper edge portion of the container and carrying a suitable feeding device.

A lower edge portion of the upper tubular part 1 comprises an upper pocket-shaped member 7 having openings with substantially horizontal axes (not shown in the drawing). An upper reinforcing member 6 extends through the upper pocket-shaped member 7. Projections 10 extend through the openings in the upper pocket-shaped member 7 and are fixedly connected to the upper reinforcing member 6. The projections 10 have upper bores 11 with substantially vertical axes.

Similarly, an upper edge portion of the lower bottom part 2 of the container comprises a lower pocket-shaped member 9 having openings (also not shown in the drawing) with substantially horizontal axes. A lower reinforcing member 8 extends through the lower pocket-shaped member 9. Projections 10 extend through the openings in the lower pocket-shaped member 9 and are fixedly connected to the lower reinforcing member 8. The projections 10 have lower bores 11 with substantially vertical axes in alignment with the upper bores 11. The reinforcing members 4, 6, and 8 are made of a rigid material.

The container comprises a support structure 15 located adjacent the lower bottom part 2. The reinforcing member 8 is fixedly connected to the support structure 15.

Screw bolts 13 extend through the upper and lower bores of the projections of the upper tubular part 1 and of the lower tubular part 2. Nuts 13' are threaded onto the screw bolts 13. Turning of the nuts 13' exerts a pulling force upon the lower edge portion of the upper tubular part 1 in a longitudinal direction towards the lower bottom part 2.

An intermediate member 14 is located intermediate the lower edge portion of the upper tubular part 1 and the lower bottom part 2. In one of the embodiments the intermediate member 14 is made as a tubular part of a flexible material having substantially the same diameter as the upper tubular part 1. During elongating the upper tubular part 1 of the container the intermediate member 14 is bent under a force exerted thereto in a longitudinal direction and lies upon an inner surface of the funnel-shaped lower bottom part 2 of the container.

Figure 3:
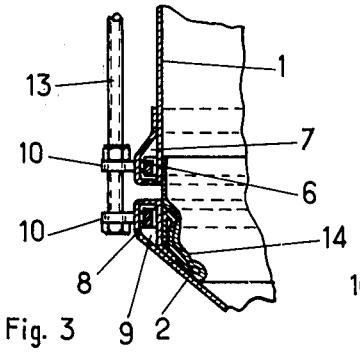
FIG. 3 is a sectional view of a detail of FIG. 1 showing one embodiment of an intermediate member in a position after an elongation of an upper tubular part.

During the process of elongating the flexible upper tubular part 1 of the container, the upper reinforcing member 6 of the upper tubular part 1 moves towards the lower reinforcing member 8 of the lower bottom part 2, and the parts of the container occupy their closest position. FIG. 3 shows the upper tubular part 1 and the lower bottom part 2 in this position. The intermediate member lies upon the inner surface of the lower bottom part 2 of the container. When the material is fed into the container the intermediate member 14 is firmly pressed against this surface under the weight of the material.

In a currently preferred embodiment of the invention an upper edge portion of the intermediate member 14 is fixedly connected to the lower edge portion of the upper tubular member 1. Such connection can for example be performed by means of glueing, welding or sewing. If the distance between the upper tubular part 1 and the lower bottom part 2 "b" is relatively large, the intermediate member 14 also can be connected to the upper edge portion of the lower bottom part 2.

Figure 4:
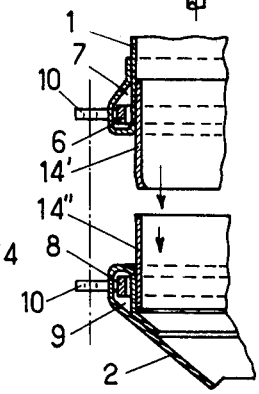
FIG. 4 is a sectional view of a detail of FIG. 1 showing another embodiment of an intermediate member prior to any elongation of an upper tubular part of a container.

In another embodiment of the present invention the intermediate member can be made of a rigid material. In this case the intermediate member can be made in form of two separate seal-like sections which are shown in FIG. 4 and designated by reference numerals 14', 14". The seal-like sections 14', 14" have tubular cross-sections corresponding to cross-sections of the upper tubular part 1 and the lower bottom part 2 of the container. The seal-like sections 14', 14" are fixedly connected to the lower edge portion of the upper tubular part 1 and the upper edge portion of the lower bottom part 2, respectively. When the upper tubular part 1 of the container elongates, the seal-like sections 14', 14" engage and slide along one another. In the position when the upper tubular part 1 has its maximum length, the seal-like members 14', 14" are fixedly connected to one another, for example by means of welding, glueing or sewing.

Figure 2:
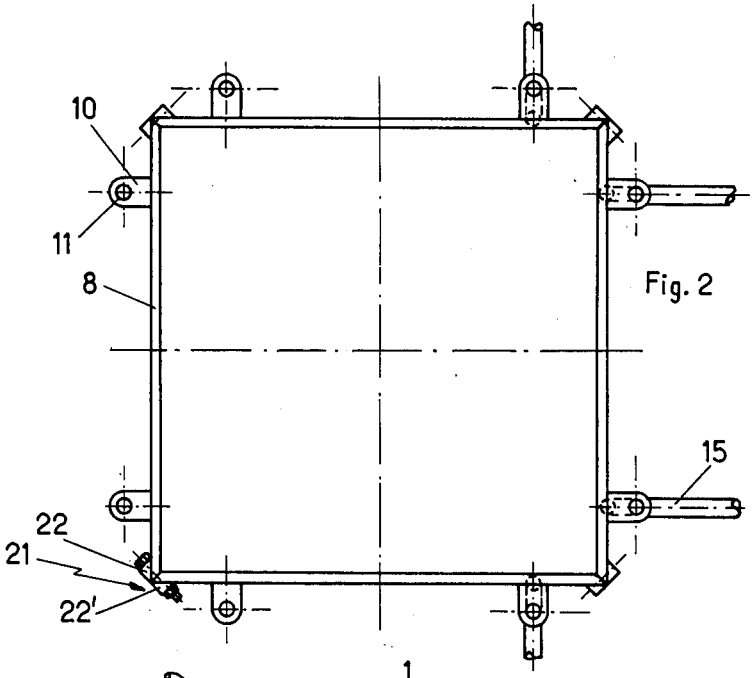
FIG. 2 is a plan view of a reinforcing member of a lower bottom part of a container.

The container may be of circular, square, oval or any other desired cross-section. The reinforcing members 4, 6 and 8 are made in a form corresponding to the form of the container. When the container has a circular cross-section the reinforcing members can be made in form of a ring which is split in one point thereof, and has means for fixedly connecting the thus created adjacent ends of the ring to one another. The ring also can consist of two or more parts. In the presented embodiment a container is shown which has a square cross-section. In this case the reinforcing members are made in form of a square frame which is clearly shown in FIG. 2. The frame consists of separate side sections connected to one another at the corners of the frame, for example by means of a screw joint 21 including two lugs 22, 22'. The lugs 22, 22' are provided with bores having axes parallel to a diagonal line of the frame. Screw bolts extend through said bores, firmly clamp the lugs 22, 22' to one another and fixedly connect the side section of the frame to one another to form rigid reinforcing members.

In another embodiment of the present invention the support structure 15 can be fixedly connected to the lower reinforcing member 8 of the lower bottom part 2 of the container, but instead to the projections 10 of the lower bottom part 2. It is also possible to make the means 21 for connecting the side sections of the lower reinforcing member 8 such that the support structure can be connected directly to the means 21 at the corners of the lower reinforcing member 8.

A method for pretreating of suspended flexible container is performed as follows.

The flexible upper tubular part 1 of the container is suspended through the suspending structure 12 in a corresponding place, for example, to a ceiling of a warehouse. The upper tubular part 1 must be so suspended that the predetermined distance "b" is provided between the upper tubular part 1 and the lower bottom part 2 of the container. This distance is necessary for an elongation of the flexible tubular part 1. The lower bottom part is located at the above mentioned distance from the upper tubular part 1, and is stationarily mounted by means of the support structure 15. Then the screw bolts 13 are received into the upper and lower bores 11 of the projections 10 of the upper and the lower reinforcing members, respectively. The nuts 13' are threaded onto the screw bolts 13. Turning of the nuts 13' on the screw bolts 13 causes a movement of the upper tubular part 1 towards the lower bottom part whereby the upper tubular part 1 elongates. The turning of the nuts 13' is continued until the upper tubular part is elongated to its maximum length. In the case when the intermediate member is in a form of an integral member 14 it slides along the inner surface of the lower tubular part 2 and lies upon this surface. In the case when the intermediate members comprise two separate seal-like sections 14' and 14", the sections engage and slide along one another, and thereafter are fixedly connected to one another. After the upper tubular part elongates to its maximum length, the turning of the nuts 13' is interrupted and in such a position the lower edge portion of the upper tubular part 1 of the container is firmly connected to the lower bottom part 2. In this position the container is left until it is desired to use it for storage. When material is fed into the container, the upper tubular part 1 which is already elongated to its maximum length cannot further elongate. This means that no overhanging and bending of portions of the upper tubular part 1 occurs, which could create difficulties for proper discharging of the material from the container. Conversely after discharge of the material from the container no shortening of the upper tubular part occurs and, therefore, no damages can be done to any rigid systems connected to the container.

While the invention has been illustrated and described as embodied in a method of pretreating suspended flexible containers and an arrangement for performing the method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An arrangement for pretreating suspended flexible containers of the type including an upper tubular part of flexible material and a rigid lower bottom part, comprising: means for suspending said container by an upper edge portion of said upper tubular part; pulling means for pulling a lower edge portion of said upper tubular part in a longitudinal direction towards said lower bottom part, and for subsequently fixedly connecting said lower edge portion of said upper tubular part to said lower bottom part; first means for connecting said pulling means to said upper tubular part, said first means including an upper pocket-shaped member connected to said lower edge portion of said upper tubular part and having openings with substantially horizontal axes, a circumferentially closed upper reinforcing member extending through said upper pocket-shaped members, and projections fixedly connected to said upper reinforcing member and extending through said openings, said projections having upper bores with substantially vertical axes; and second means for connecting said pulling means to said lower bottom part.

2. The arrangement as defined in claim 1, wherein said second means comprises a lower pocket-shaped member connected to said upper edge portion of said lower bottom part and having openings with substantially horizontal axes, a circumferentially closed lower reinforcing member extending through said lower pocket-shaped member, and projections fixedly connected to said lower reinforcing member and extending through said openings, said projections having lower bores with substantially vertical axes in alignment with said upper bores of said first means.

3. The arrangement as defined in claim 2, wherein said pulling means comprises screw bolts extending through said upper bores and said lower bores, and nuts threaded into said screw bolts so that turning of said nuts causes a movement of said first means towards said second means, and thereby pulling said lower edge portion of said upper tubular part toward said lower bottom part, and fixedly connecting the former to the latter.

4. The arrangement as defined in claim 2, wherein said upper tubular part and said lower bottom part are of a circular cross-section; and said reinforcing members are split rings located in the respective pocket-shaped members, and including means for fixedly connecting the ends of each of said rings to one another.

5. The arrangement as defined in claim 2, wherein said upper tubular part and said lower bottom part have square cross-sections; and said reinforcing members are square frames located in the respective pocket-shaped members, said square reinforcing members each comprising separate side sections and having means for fixedly connecting said side sections to one another.

6. The arrangement as defined in claim 2, further comprising a support structure for supporting said lower bottom part; the reinforcing member of said second means being fixedly connected to said support structure.

7. A suspended flexible container arrangement of the type including an upper tubular part of flexible material and a rigid lower bottom part, comprising means for suspending said container by an upper edge portion of said upper tubular part; means for preventing elongation of said tubular part during admission of a material therein and shortening of said tubular part after withdrawal of the material therefrom by pulling a lower edge portion of said upper tubular part in a longitudinal direction towards said lower bottom part, and fixedly connecting said lower edge portion of said upper tubular part to said lower bottom part so that said tubular part is held prestretched; a tubular intermediate member located between said upper tubular part and said lower bottom part, said tubular intermediate member being composed of a rigid first tubular section connected to and movable with said upper tubular part and a rigid second tubular section connected to said lower bottom part, said tubular sections being arranged to overlap in response to pulling of said upper tubular part towards said lower bottom part; first means for connecting said preventing means to said tubular part; and second means for connecting said preventing means to said lower bottom part.

8. The arrangement as defined in claim 7, wherein said lower bottom part is funnel-shaped; and further comprising discharge means mounted at a lower portion of said funnel-shaped bottom part.

9. An arrangement for pretreating suspended flexible containers of the type including an upper tubular part of flexible material and a rigid lower bottom part, comprising: means for suspending said container by an upper edge portion of said upper tubular part, said suspending means comprising a pocket-shaped member connected to said upper edge portion of said upper tubular part and having openings, a circumferentially closed reinforcing member extending through said pocket-shaped member, and a suspending structure extending through said openings and fixedly connected to said reinforcing member; pulling means for pulling a lower edge portion of said upper tubular part in a longitudinal direction towards said lower bottom part, and for subsequently fixedly connecting said lower edge portion of said upper tubular part to said lower bottom part; first means for connecting said pulling means to said upper tubular part; and second means for connecting said pulling means to said lower bottom part.

* * * * *